United States Patent [19]

Reschly et al.

[11] Patent Number: 4,987,837

[45] Date of Patent: Jan. 29, 1991

[54] SIFTINGS REMOVAL DEVICE

[75] Inventors: David C. Reschly, Monroe; Kenneth D. Alt, Erie, both of Mich.

[73] Assignee: Detroit Stoker Company, Monroe, Mich.

[21] Appl. No.: 459,990

[22] Filed: Jan. 2, 1990

[51] Int. Cl.[5] ..... F23J 1/00

[52] U.S. Cl. ..... 110/165 R; 110/110; 110/255; 110/259

[58] Field of Search ..... 110/165 R, 255, 259, 110/110

[56] References Cited

U.S. PATENT DOCUMENTS

| | | | |
|---|---|---|---|
| 575,981 | 1/1897 | Parr . | |
| 807,890 | 12/1905 | Watson et al. . | |
| 1,160,360 | 11/1915 | Atterbury et al. . | |
| 1,922,960 | 8/1933 | Klein | 110/110 |
| 2,558,626 | 6/1951 | Pfau . | |
| 2,794,406 | 6/1957 | Stark . | |
| 2,806,439 | 9/1957 | Wagner . | |
| 2,983,234 | 5/1961 | Reilly . | |
| 3,007,576 | 11/1961 | Hannaford . | |
| 3,023,716 | 3/1962 | Reisman . | |
| 3,126,846 | 3/1964 | Wagner . | |
| 3,855,950 | 12/1974 | Hughes, Jr. et al. . | |
| 3,910,208 | 10/1975 | Albrecht et al. . | |
| 3,958,518 | 5/1976 | Yeshida . | |
| 4,009,667 | 3/1977 | Tyer et al. . | |
| 4,026,223 | 5/1977 | Robbins . | |
| 4,109,590 | 8/1978 | Mansfield | 110/165 R X |
| 4,287,838 | 9/1981 | Frosch | 110/255 X |
| 4,321,877 | 3/1982 | Schmidt et al. . | |
| 4,326,469 | 4/1982 | Reschly . | |
| 4,437,452 | 3/1984 | Reschly . | |
| 4,454,860 | 6/1984 | Schafer et al. . | |
| 4,503,783 | 3/1985 | Musschoot . | |
| 4,534,301 | 8/1985 | Sakash et al. . | |
| 4,574,103 | 3/1986 | Pickard . | |
| 4,579,067 | 4/1986 | Peters . | |
| 4,602,572 | 7/1986 | Giaier et al. . | |
| 4,616,573 | 10/1986 | Giaier et al. . | |
| 4,622,903 | 11/1986 | Warren et al. . | |
| 4,625,660 | 12/1986 | Brungger et al. . | |
| 4,735,189 | 4/1988 | Murphy et al. . | |
| 4,744,314 | 5/1988 | Hoskinson . | |
| 4,790,251 | 12/1988 | Vidt . | |
| 4,901,652 | 2/1990 | Pressnall et al. | 110/165 X |

*Primary Examiner*—Edward G. Favors

*Attorney, Agent, or Firm*—Harness, Dickey & Pierce

[57] ABSTRACT

A furnace having an ash discharge system which collects and receives siftings falling from portions of the incinerator grate and at the same time provides for controlled emission of air for combustion of the fuel to separate sections of the grate independently. The siftings removal system includes a hopper for receiving siftings that also forms part of an air plenum for directing and controlling the flow of combustion air to the furnace. A rotating conveyor is disposed within the hopper for removing ash from the hopper. An air seal divides the hopper into separate air chambers, each of the chambers being independently supplied with a source of pressurized air. The system also includes a means to separately control the air supply to each chamber.

18 Claims, 4 Drawing Sheets

SIFTINGS REMOVAL DEVICE

BACKGROUND OF THE INVENTION

This invention relates to incinerators and furnaces and, more particularly, to systems for removing ash and residue from a furnace while maintaining and controlling the flow of combustion air.

Disposal of municipal and industrial refuse is a critical problem due to a shortage of landfill sites. Burning such refuse is a desirable alternative because it greatly reduces the volume of waste. Burning has an added benefit because incinerators using refuse as fuel can also be used to generate usable energy.

However, due to the heterogeneous nature of such refuse, it is difficult to maintain a degree of efficiency in the combustion process. Efficient combustion in an incinerator may be facilitated by controlling the pressure and volume of combustion air within the combustion chamber. Unfortunately, the process of disposing of residue and ash from the furnace can disturb the balance of pressure and temperature within the combustion chamber. As a result, it is often a problem for incinerator ash removal systems to dispose of ash while maintaining the combustion chamber air seal. This problem is even more acute in furnaces requiring precise control over combustion chamber temperature and pressure.

For example, in incinerators using municipal and industrial refuse as fuel, it may be desired to have independent control of the combustion environment within various sections of the incinerator. This is because such refuse varies widely in bulk, density, moisture and combustibility. This variation in the combustibility of the refuse makes it difficult to burn the refuse in an efficient manner due to the inability to maintain a fuel bed of uniform density.

One approach to this problem is to provide a large supply of combustion air for fast burning components of the refuse, and to provide a reduced combustion air flow to the slower burning refuse components. One example of an incinerator of this type is U.S. Pat. No. 3,126,846. That patent employs a movable grate to convey burning refuse along the grate surface. Multiple sections of the grate are supplied with a source of combustion air that varies in pressure and volume for each section depending on the rate of desired burning in that section. In incinerators with movable grates, however, some of the ash or residue will inevitably fall through the grate in the form of siftings. A problem arises in removing the siftings in an automatic and efficient manner, without disturbing the control of the airflow into the various portions of the combustion chamber.

Thus, it is an object of the present invention to provide a method for automatically removing ash siftings falling through a furnace grate.

Another object of the present invention is to provide a system for removing siftings from a grate that does not disturb the controlled air flow to separate sections of a grate.

A further object of the present invention is to provide all of the above objects in a system that is cost efficient and minimizes the number of components that must be added to the incinerator.

SUMMARY OF THE INVENTION

According to the present invention, a system is provided for conveying ash in an incinerator. The apparatus includes a hopper for receiving ash falling through the incinerator grate, the hopper forming part of an air plenum for directing and confining the flow of combustion air in the furnace. A rotating conveyor is disposed within the hopper for removing ash from the hopper. An air seal divides the hopper into separate air chambers, each of these chambers being supplied with a source of pressurized air. The system also includes a means to separately control the air pressure supply to each chamber.

In the preferred embodiment, the rotating conveyor includes a rotatable shaft disposed in the bottom portion of the hopper. The shaft is provided with a series of paddles protruding radially at regular intervals along the length of the shaft. The paddles are also tilted with respect to the plane transverse to the axis of the shaft so that rotation of the paddles will convey the ash received by the hopper in a direction along the axis of the shaft. The system effectively removes ash from the furnace while maintaining independent control over the air flow in separate portions of the combustion chamber.

Other objects, features, and advantages of the present invention will become apparent from the subsequent description and the appended claims, taken in conjunction with the accompanying drawings

BRIEF DESCRIPTION OF THE DRAWINGS

FIG. 3 is a side electorial view of the siftings hopper shown in FIG. 2.

DESCRIPTION OF THE PREFERRED EMBODIMENTS

Figure 1:
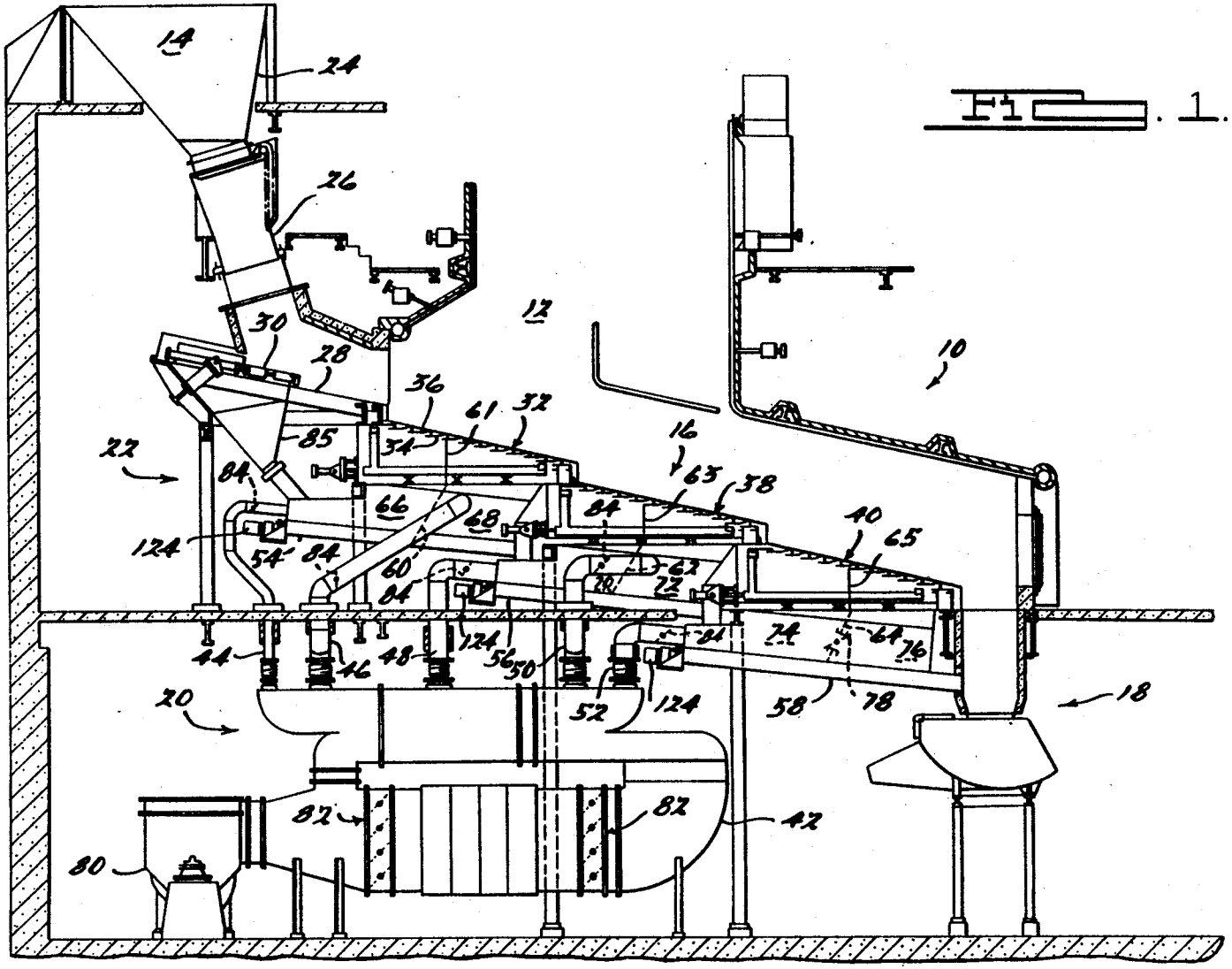
FIG. 1 is a vertical sectional view of the furnace portion of an incinerator incorporating the siftings discharge apparatus of the present invention.
Figure 2:
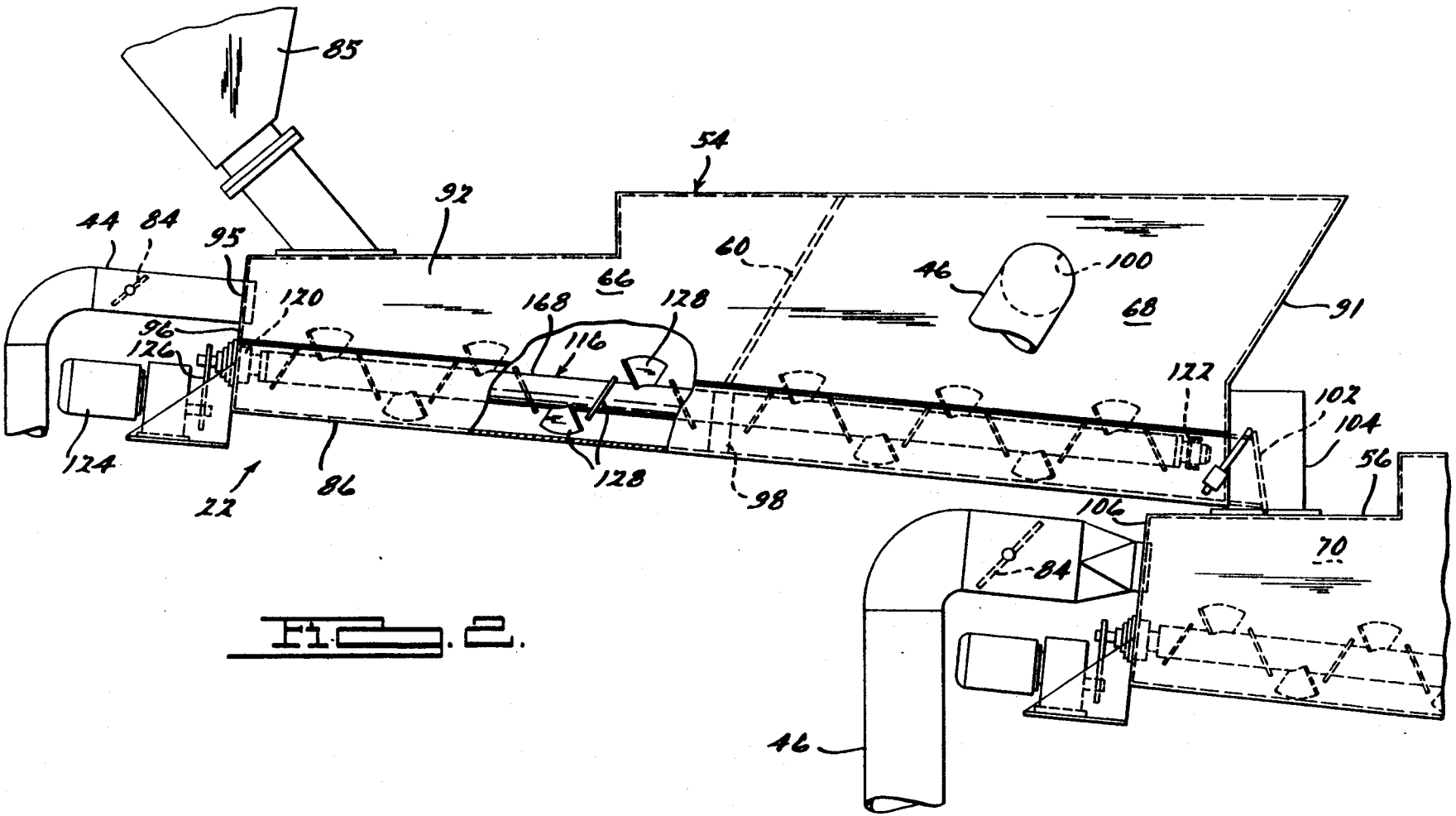
FIG. 2 is a vertical sectional view of the incinerator of FIG. 1 showing the siftings discharge system of the present invention.
Figure 2:
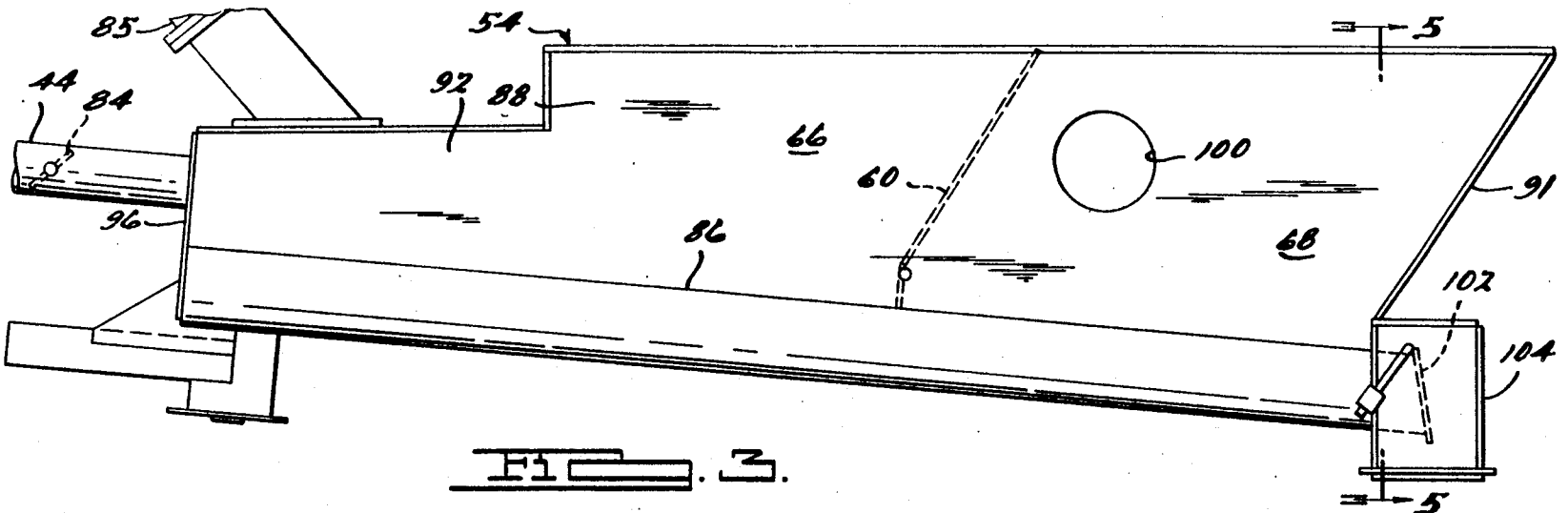

Referring now to FIG. 1, an improved refuse burning incinerator is illustrated. The incinerator 10 is generally of a type used to burn industrial and municipal refuse. The incinerator 10 includes a furnace area 12, a fuel feed area 14, a reciprocating grate 16, an ash discharge area 18, combustion air supply system 20, and a siftings removal system 22.

Refuse is fed to the incinerator 10 into the fuel feed area 14 by first entering a charging hopper 24. The charging hopper 24 can be loaded with refuse to be burned either manually or by mechanical means, such a conveyor, overhead crane, bulldozer, or the like. The refuse slides down a feed chute 26 onto an inclined surface 28 and is pushed by a ram or pusher unit 30 so that it falls onto a first section 32 of the grate 16. The first grate section 32 is formed of a plurality of overlapping substantially horizontal, grate bars 34 and 36 which are alternately arranged. That is, movable grate bars 36 are provided between each adjacent pair of stationary bars 34. The front ends of the movable grate bars 36 overlap the rear or back ends of the stationary grate bars 34 while the front ends of the stationary grate bars 34 overlap the rear or back ends of the movable grate bars 36. The movable grate bars 36 are reciprocatable relative to the stationary bars 34, and reciprocate from front to rear relative to the incinerator 10 or from left to right as viewed in FIG. 1 so as to move refuse thereon from left to right. Further details of the reciprocating grate 16 of the preferred embodiment ma be found in U.S. Pat. No. 3,126,846, which is incorporated herein by reference.

Once refuse is moved by the reciprocating action to the end of the first section 32, it falls on to a second grate section 38, which is similar to the first grate section 32. Likewise, refuse is moved by reciprocating grate bars 34 and 36 along the second grate section 38 until it falls onto the third grate section 40. Again, third grate section 40 moves refuse by means of reciprocating grate bars 34 and 36 until the refuse eventually falls into the ash discharge area 18.

Combustion air supply system 20 includes a main air supply duct 42 and five secondary ducts 44, 46, 48, 50, and 52. Combustion air from the secondary ducts 44–52 enters separate chambers in the siftings removal system 22 and is directed through individual grate members 34 and 36 into the furnace area 12, as will be discussed in more detail below.

The siftings removal system 22 includes a first siftings hopper 54, second siftings hopper 56, and third siftings hopper 58. The siftings hoppers 54, 56, and 58, are divided by air seal plates 60, 62, and 64, into two air sections for each siftings hopper. Siftings hopper 54 is divided into a first air chamber 66 and second air chamber 68; siftings hopper 56 is divided into a first air chamber 70 and a second air chamber 72 and siftings hopper 58 is divided into a first air chamber 74 and a second air chamber 76. Three buffers 61, 63 and 65 are attached to the top of seal plates 60, 62 and 64, respectively, to extend the air chambers 66, 68, 70, 72, 74 and 76 upward to the underside of the grate 16.

First secondary air duct 44 thereby directs combustion air into the first air chamber 66 of siftings hopper 54. Likewise, second secondary air duct 46 directs combustion air into the second air chamber 68 of siftings hopper 54. Air duct 48 directs combustion into the first air chamber 70 of siftings hopper 56, and air duct 50 directs combustion air into the second chamber 72 of siftings hopper 56. Finally, air duct 52 directs combustion air into the first air chamber 74 of siftings hopper 58. In this case, however, the second air chamber 76 of siftings hopper 58 does not have a separate air duct, but instead, receives a controlled amount of combustion air through air damper 78 from the first chamber 74 of siftings hopper 58. The reason for not providing a separate air duct for second air chamber 76 is that a lesser amount of combustion air is required for the final section of the third grate 40, as will be discussed below.

Combustion air is supplied in the combustion air system 20 by a conventional motor driven blower 80 which directs air into the main air duct 42. The volume of air flowing in main air duct 42 can be controlled by a series of air damper assemblies 82. The volume of air flowing through each of the secondary air ducts 44–52 is controlled by a series of air damper assemblies 84 located in each duct, as best shown in FIGS. 1, 2, 3 and 7. Combustion air flowing upward through siftings hoppers 54, 56 and 58 is directed to the underside of the grate 16. Holes (not shown) in the grate bars 34, 36 permit this air to enter the combustion chamber 12.

Relatively precise control of the air flow into various sections of the grate 16 may be coordinated with the relative speed of the reciprocating action of movable grate bars 36 to achieve control of the burning of refuse in the following manner. Refuse reaching the first grate section 32 contains a substantial portion that is highly combustible and will burn very rapidly. For this purpose, movable grate sections 36 are set to reciprocate very rapidly and the damper 84 in the first secondary duct 44 is adjusted to provide for a large supply of combustion air to the first air chamber 66 in the first siftings hopper 54.

The less combustible portion of the refuse, which has not burned initially, can be burned at a slower rate when it reaches the portion of grate 32 directly above the second air chamber 68 by providing a reduced air supply through secondary air duct 46. This can be accomplished by adjusting the damper 84 in the air duct 46. When refuse reaches the end of the first grate section 32 it tumbles off the end thereof onto the upper end of the second grate section 38. Likewise, movable grate bars 36 in the second grate section 38 can be moved at a slower rate and air supply to air chamber 70 and 72 can be reduced by controlling the air damper 84 in secondary air ducts 48 and 50.

In a similar manner, refuse tumbles off secondary grate section 38 onto third grate section 40 where it can be reciprocated at an even slower rate in third grate section 40. Also, the air supply in air chamber 74 may be reduced even further by controlling damper 84 in air duct 52. Reduced air supply in air chamber 76 is achieved by controlling damper 78. In this way, refuse which is difficult to burn, namely bundles of paper, books, green grass clippings, and so on, have been thoroughly dried by the time they are tumbled onto the third grate section 40, so that they ignite on this grate section and burn efficiently and are decomposed into clean ash. In this way, a fuel bed of uniform density is maintained over the entire length of the grate irrespective of the variable burning characteristics of the material being burned to thereby make it possible to use the incinerator at full capacity at all times Ash residue, non-combustible materials, such as tin cans, are discharged off the third grate section 40 into the ash discharge portion 18. Ash discharge portion 18 may be a conventional ash disposing apparatus, such as an ash pit, or a flooded ash conveyor.

As refuse is burned on the grate 16, ash siftings will fall through the grate 16 between the stationary 34 and movable grate portion 36 due to space between these adjacent grate members. Also, some ash siftings will fall through the holes (not shown) in the grate bars 34, 36 provided to permit combustion air to pass through. Siftings hoppers 54, 56, and 58 are disposed so as to collect these siftings falling through the grate system 16. Similarly, a charge siftings hopper 85 is provided to collect small particles of the unburned refuse which fall through the inclined surface 28 adjacent to the charging ram 30.

As shown more clearly in FIGS. 2–5, the siftings hopper 54 includes a rectangular trough bottom portion 86 into which ash siftings as well as charge siftings from hopper 85 collect. The air chambers are formed by angled side walls 88 and 90, rear wall 91, air plate seal 60, rectangular trough 86 and the siftings intake chamber 92, the latter having an opening 94 for receiving charge siftings from the hopper 85. Combustion air enters first air chamber 66 through an opening 95 in the front wall 96 of siftings intake chamber 92. Secondary air duct 44 terminates at this opening in front wall 96 supplying air to the air chamber 66. In addition, an air seal tube 98 is positioned at the bottom of the air seal plate 60 to further provide air seal for chamber 66 while permitting ash siftings to move from air chamber 66 to air chamber 68. As will be explained in more detail below, air seal tube 98 will permit siftings to move from air chamber 66 to air chamber 68 while maintaining separate air pressures within the two chambers.

Figure 4:
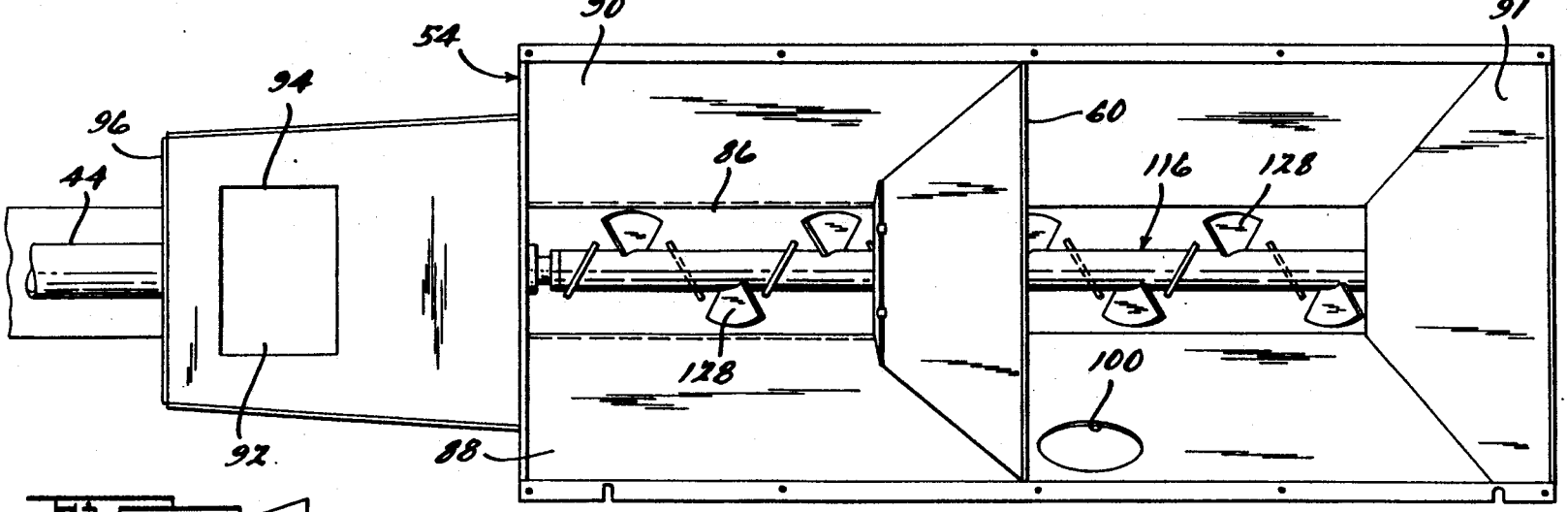
FIG. 4 is a top plan view of the siftings hopper shown in FIG. 3.
Figure 5:
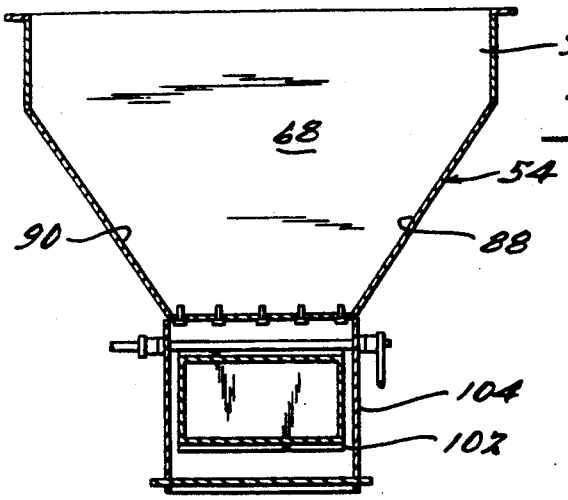
FIG. 5 is a transverse sectional view of the siftings hopper taken generally along line 5—5 in FIG. 3.

As best shown in FIG. 4, the top of air chamber 66 is open and immediately below the upper portion of first grate section 32 to provide a supply of combustion air to the underside of grate section. This combustion air then passe through openings in grate section 32 into the furnace area 12. Air chamber 68 is similarly positioned under the lower portion of first grate section 32 to provide a supply of combustion air to that portion of the first grate section 32. Combustion air enters air chamber 68 through opening 100 in the side wall 88 of air chamber 68. Secondary air duct 46 terminates at opening 100 to supply combustion air to air chamber 68.

A normally closed weight-balanced gate 102 serves to seal the lower rearward portion of trough 86, while still permitting siftings to be removed therefrom by merely pushing the gate open. Siftings which leave air chamber 68 through gate 102 enter transfer chamber 104 and fall into the trough 86 of siftings hopper 56. Siftings hopper 56 is constructed in a manner similar to siftings hopper 54 with combustion air entering through an opening in front wall 106 from secondary air duct 48. Likewise, sifting hopper 56 is similar to siftings hopper 54 discussed above.

Referring now to FIGS. 2–5, further details of the siftings removal system 22 are shown. Positioned longitudinally in siftings trough 86 of siftings hopper 54 is a paddle type siftings conveyor 116. Siftings conveyor 116 includes a shaft 118 which is rotatably mounted to first and second bearings assemblies 120 and 122. Shaft 118 is rotated by means of motor 124 which is engaged with shaft 118 by means of a conventional power transferring mechanism 126, which may include pulleys and belts, sprockets and chains, or the like. Mounted on shaft 118 are a series of paddles 128 which are mounted so as to protrude radially from shaft 118 at regular intervals along the length of shaft 118. In the preferred embodiment, the paddles 128 are located every 90 degrees around the circumference of shaft 118. It can further be seen in FIG. 2 that paddles 128 are tilted at about a 30 degree angle with respect to a plane perpendicular to the axis of shaft 118. Because of this tilt, when shaft 118 is rotated (clockwise when viewed from the front end at motor 124) siftings in trough 86 will be pushed toward the right of FIG. 3. Siftings reaching weighted gate 102 will push it open, and permit siftings to enter transfer chamber 104 where they will fall into the second siftings hopper 56.

Siftings passing from air chamber 66 into air chamber 68 encounter seal tube 98 attached to the bottom portion of air seal plate 60. Siftings conveyed by paddles 128 in air chamber 66 will pass through and substantially fill tube 98 as they are conveyed into air chamber 68. In this way, the siftings will maintain a seal within the tube 98 between the separate air chamber 66 and 68. Likewise, it should also be noted that when door 102 is opened to permit siftings to pass out of air chamber 68, the mass of siftings will substantially fill the opening and maintain the air seal in air chamber 68 while door is open. It will also be appreciated that immediately adjacent to air seal plate 60, there will not be a paddle 128 on shaft 118 in order to provide clearance with the air seal plate 60 and the seal tube 98. Alternatively, instead of the seal tube 98, a weighted gate such as weighted gate 102 could be used.

Figure 6:
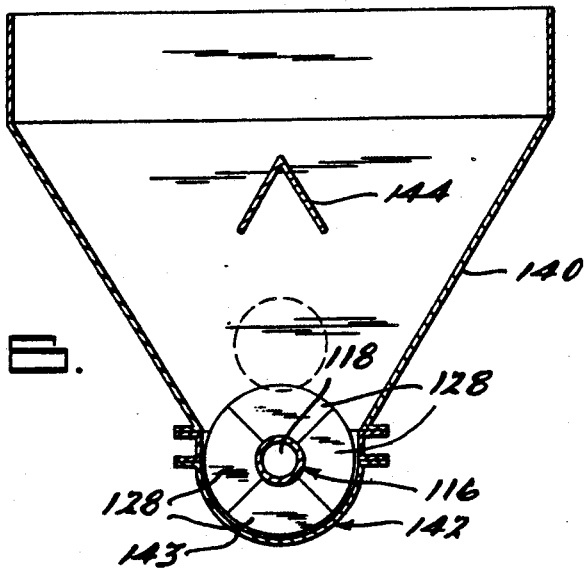
FIG. 6 is a view similar to FIG. 5 showing a second embodiment of the present invention.

Referring now to FIG. 6, an alternative embodiment of a siftings hopper is shown. Siftings hopper 140 is similar in construction to siftings hoppers 54, 56, and 58 with the exception that rectangular trough 86 has been replaced with a rounded trough 142. It should be noted that with rectangular trough 86, siftings will build up in portions of the trough 86 not reached by the circular path of rotating paddles 128. This will cause siftings to build up and move against stationary siftings. By reducing the movement of siftings against the trough 86, wear of the bottom section of trough 86 will be reduced. In contrast, circular trough 142 will not permit siftings to build up and the paddles 128 will effectively remove substantially all of the siftings in trough 142. It should be noted that circular trough 142 has a bottom portion 143 which can be removed for maintenance and replacement of individual paddles, for cleaning or for replacement of the shaft 118. In addition, bottom panel 143 may be hinged to facilitate cleaning and maintenance. Referring again to FIG. 6 an optional shield 144 is configured in an inverted 'V' shape and is mounted longitudinally over the entire length of shaft 118. Shield 144 is designed to protect shaft 118 from damage by siftings which would otherwise fall directly on shaft 118. For example, molten aluminum may be included in the siftings and it is desirable to prevent it from falling directly on the shaft 118. Thus, shield 144 deflects siftings to either side of shaft 118.

Figure 7:
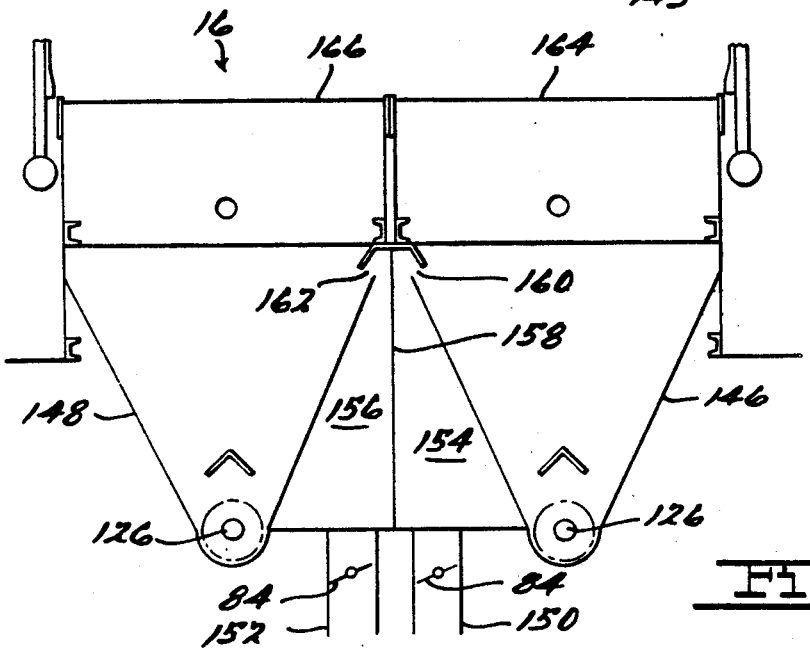
FIG. 7 is a diagrammatic view similar to FIG. 5 showing a third embodiment of the present invention.

Referring now to FIG. 7, an additional alternative embodiment is shown in which dual siftings hoppers 146 and 148 are employed. In this arrangement, in place of a single siftings hopper, two side-by-side siftings hoppers are employed under a given section of grate 16. This will necessitate the use of two sifting conveyor shafts 126 having paddles 128. Also, secondary air ducts 150 and 152 will provide air to the first and second siftings hoppers 146 and 148, respectfully. This is accomplished by means of additional air chambers 154 and 156 which are divided by an air seal plate 158. Air from chamber 154 passes through opening 160 into siftings hopper 146. Likewise, air from air chamber 156 passes through opening 162 into siftings hopper 148. In FIG. 7 the grate 16 is in two sections across its width (not shown). The first section 164 lies above siftings hopper 146 and a second section 166 lies above siftings hopper 148. In this way, it can be seen that independent control of air supply to the two sections 164 and 166 across the width of grate 116 can be achieved by adjusting air dampers 84. Depending on the type of incinerator, one, two, three or four grate sections may be employed. However, it will be appreciated that the same number of siftings conveyor systems 22 will need to be employed to carry away the siftings falling below them.

Thus, there is disclosed in the above description and in the drawings, several illustrative embodiments of the invention which fully and effectively accomplishes the objects thereof. However, it will be apparent that variations in the details of the apparatus may be indulged in without departing from the sphere of the invention herein described, or the scope of the appended claims.

What is claimed is:

1. An apparatus for conveying ash in a furnace having a grate with openings therethrough, said apparatus comprising:

a hopper for receiving ash falling through said grate;

conveyor means extending the length of said hopper for removing ash from said hopper;

air seal means for dividing said hopper into separate air chamber wherein said conveyor means extends through a plurality of said air chambers;

air supply means to independently supply pressurized air for combustion to said separate air chambers, from which it blows through said grate to aid in the combustion of fuel on said grate; and means to independently control the pressure of air supply to each said air chamber.

2. The apparatus of claim 1 wherein said conveyor means comprises:

a rotatable shaft disposed near the bottom portion of said hopper;

a series of paddles protruding radially along the length of said shaft, said paddles being tilted with respect to a plane transverse to the axis of the shaft, whereby rotation of the shaft and paddles will convey said ash received by said hopper in a direction along the axis of the shaft.

3. An apparatus for conveying ash in a furnace having a grate with openings therethrough, said apparatus comprising:

a hopper for receiving ash falling through said grate;

conveyer means extending the length of said hopper for removing ash from said hopper;

air seal means for dividing said hopper into separate air chambers, wherein said air seal means comprises a plate dividing said hopper into multiple sections, and a tube attached to the lower portion of said plate, wherein said conveyed ash passes through said tube and said ash facilitates sealing the air between said separate air chamber;

air supply means to independently supply pressurized air for combustion to said separate air chambers, from which it blows through said grate to aid in the combustion of fuel on said grate; and means to independently control the pressure of air supply to each said air chamber.

4. The apparatus of claim 1 further comprising a weight-balanced gate for permitting ash to be transferred by said conveyor out of said hopper while maintaining an air seal to said air chambers.

5. The apparatus of claim 1 wherein said hopper is disposed under said grate and said ash falls through said grate into said hopper.

6. The apparatus of claim 5 wherein said grate has movable sections and said ash falls between said movable sections into said hopper.

7. An apparatus for conveying ash in a furnace having a grate with openings therethrough, said apparatus comprising:

a hopper disposed under said grate for receiving ash falling through said grate;

conveyor means extending the length of said hopper for removing ash from said hopper;

air seal means for dividing said hopper into separate air chambers;

air supply means to independently supply pressurized air for combustion to said separate air chambers, from which it blows through said grate to aid in the combustion of fuel on said grate;

means to independently control the pressure of air supply to each said air chamber;

a second hopper disposed under a second portion of said grate;

a second conveyor means for removing ash from said second hopper;

a second air seal means for dividing said second hopper into separate air chambers; and a gate means for receiving ash from said conveyor means and for transferring said ash from said hopper to said second hopper while maintaining an air seal between said hoppers.

8. The apparatus of claim 7 wherein said second portion of said grate is lower than said first section.

9. An apparatus for conveying ash in a furnace having a grate with opening therethrough, said apparatus comprising:

a hopper for receiving ash falling through said grate;

conveyor means extending the length of said hopper for removing ash from said hopper;

air seal means for dividing said hopper into separate air chambers;

air supply means to independently supply pressurized air for combustion to said separate air chambers, from which it blows through said grate to aid in the combustion of fuel on said grate;

means to independently control the pressure of air supply to each said air chamber; and a rotating shaft for said conveyor means and an elongated shield disposed below said grate and above said shaft to prevent materials from falling through said grate onto said shaft.

10. The apparatus of claim 9 wherein said shield is of an inverted 'V' shaped in cross-section.

11. The apparatus of claim 1 wherein said hopper further comprises at least one bottom segment which is hingably mounted to swing away facilitate cleaning and servicing.

12. The apparatus of claim 1 wherein said bottom portion of said hopper is rectangular in cross-section and said conveyor means is disposed in said bottom portion and surrounded by 3 sides of said rectangular bottom portion.

13. The apparatus of claim 1 wherein said bottom portion of said hopper is semicircular in cross-section.

14. The apparatus of claim 1 further comprising an additional hopper parallel to said hopper and additional conveyor means extending the length of said additional hopper.

15. In a furnace having a grate on which burning fuel is supported, and means to admit air from below the grate to said fuel, the grate permitting siftings to fall through said grate, an improved siftings discharge system comprising:

a hopper for receiving siftings falling through said grate, said hopper forming part of an air plenum for directing and controlling the flow of combustion air to said furnace;

rotating conveyor means in said hopper for removing ash from said hopper;

air seal means for dividing said hopper into separate air chambers wherein said conveyer means extends through a plurality of said air chambers, air supply means to independently supply pressurized air to said separate air chambers; and means to independently cotrol the air pressure supply to each said air chamber.

16. The apparatus of claim 15 wherein said rotating conveyor means further comprises:

a rotatable shaft disposed near the bottom portion of said hopper;

a series of paddles protruding radially along the length of said shaft, said paddles being tilted with respect to a plane transverse to the axis of the shaft, whereby rotation of the shaft and paddles will convey said siftings received by said hopper in a direction along the axis of the shaft.

17. In a furnace having a grate on which burning fuel is supported, and means to admit air from below the great to said fuel, the grate permitting siftings to fall through said grate, an improved siftings discharge system comprising:

a hopper for receiving siftings falling through said grate, said hopper forming part of an air plenum for directing and controlling the flow of combustion air to said furnace;

rotating conveyor means in said hopper for removing ash from said hopper;

air seal means for dividing said hopper into separate air chamber, wherein said air seal means comprises a plate dividing said hopper into multiple sections, and a tube attached to the lower portion of said plate, wherein said conveyed ash passes through said tube and said siftings facilitate sealing the air between said separate air chambers;

air supply means to independently supply pressurized air to said separate air chambers; and means to independently control the air pressure supply to each said air chamber.

18. A furnace comprising:

a grate on which burning fuel is supported;

means to admit air from below the grate to said fuel;

a first hopper disposed under said grate for receiving siftings falling through said grate, said hopper forming part of an air plenum for directing and controlling the flow of combustion air to said furnace;

a second hopper disposed under a second portion of said grate for receiving siftings falling through said grate, said second hopper forming part of a second air plenum for directing and controlling the flow of combustion air to said furnace;

a rotating conveyor means for removing siftings from each of said hoppers including a rotatable shaft disposed near the bottom of each said hopper, and a series of paddles protruding radially along the length of said shaft, said paddles being titled with respect to a plane transversed to the axis of the shaft, whereby rotation of the shaft and paddles will convey said siftings received by said hopper in a direction along the axis of the shaft;

air seal means for dividing each said hopper into separate air chambers including a plate and a tube attached to the lower portion of said plate, wherein said conveyed siftings pas through said tube and facilitate sealing the air between said separate air chambers;

air supply means to independently supply pressurized air to said separate air chambers;

means to independently control the air pressure supplied to each chamber; and gate means for receiving siftings from said rotating conveyor means and transferring said siftings from said first hopper to said second hopper while maintaining an air seal between said hoppers.

* * * * *

UNITED STATES PATENT AND TRADEMARK OFFICE

CERTIFICATE OF CORRECTION

PATENT NO. : 4,987,837

DATED : January 29, 1991

INVENTOR(S) : David C. Reschly et al

It is certified that error appears in the above-identified patent and that said Letters Patent is hereby corrected as shown below:

On the title page under U.S. Patent Documents, reference to "Pickard", "4,574,103" should be -- 4,574,710 --.

Column 2, line 58, after "such" insert -- as --.

Column 3, line 8, "ma" should be -- may --.

Column 4, line 42, after "time" insert -- . --.

Column 5, line 32, "sifting" should be -- siftings --.

Column 7, line 8, "chamber" should be -- chambers --.

Column 8, line 16, "opening" should be -- openings --.

Column 8, line 38, after "away" insert -- to --.

Column 8, line 67, "cotrol" should be -- control --.

UNITED STATES PATENT AND TRADEMARK OFFICE

CERTIFICATE OF CORRECTION

PATENT NO. : 4,987,837

DATED : January 29, 1991

INVENTOR(S) : David C. Reschly et al

It is certified that error appears in the above-identified patent and that said Letters Patent is hereby corrected as shown below:

Column 9, line 13, "great" should be -- grate --.

Column 9, line 24, "chamber" should be -- chambers --.

Column 10, line 16, "titled" should be -- tilted --.

Column 10, line 24, "pas" should be -- pass --.

Signed and Sealed this

Thirtieth Day of March, 1993

*Attest:*

STEPHEN G. KUNIN

*Attesting Officer*

*Acting Commissioner of Patents and Trademarks*